US008113136B2

(12) United States Patent
Mayrand et al.

(10) Patent No.: US 8,113,136 B2
(45) Date of Patent: Feb. 14, 2012

(54) CONVERTIBLE SEAT ASSEMBLY FOR A WATERCRAFT

(75) Inventors: Jacques Mayrand, Sherbrooke (CA); Luc Quirin, Bolton (CA); Alexandre Curthelet, Granby (CA); Steve Tetreault, Sherbrooke (CA)

(73) Assignee: BRP US Inc., Sturtevant, WI (US)

( * ) Notice: Subject to any disclaimer, the term of this patent is extended or adjusted under 35 U.S.C. 154(b) by 201 days.

(21) Appl. No.: 12/508,802

(22) Filed: Jul. 24, 2009

(65) Prior Publication Data

US 2010/0319604 A1 Dec. 23, 2010

Related U.S. Application Data

(60) Provisional application No. 61/219,650, filed on Jun. 23, 2009.

(51) Int. Cl.
*B63B 17/00* (2006.01)

(52) U.S. Cl. ..... 114/363

(58) Field of Classification Search ..... 114/363; 297/14

See application file for complete search history.

(56) References Cited

U.S. PATENT DOCUMENTS

| | | | | |
|---|---|---|---|---|
| 2,928,105 | A * | 3/1960 | Bohnsack | 5/43 |
| 4,248,476 | A | 2/1981 | Phelps | |
| 4,913,487 | A * | 4/1990 | Breckel et al. | 297/14 |
| 4,919,068 | A | 4/1990 | Lathers | |
| 5,205,608 | A * | 4/1993 | Stig | 297/238 |
| D356,289 | S * | 3/1995 | Trent | D12/318 |
| 6,015,186 | A | 1/2000 | Grieger | |
| 6,406,084 | B1 | 6/2002 | De Campos et al. | |
| 6,932,427 | B2 * | 8/2005 | Tamura | 297/217.1 |
| 7,066,548 | B2 | 6/2006 | Butler | |
| 7,077,463 | B2 | 7/2006 | Sun et al. | |
| 7,367,616 | B2 * | 5/2008 | Summerford | 297/14 |
| 2007/0114819 | A1 | 5/2007 | Dougherty | |
| 2009/0072572 | A1 | 3/2009 | Scheinberg | |
| 2009/0108653 | A1 | 4/2009 | Fissette et al. | |
| 2010/0037814 | A1 * | 2/2010 | Sahr et al. | 114/363 |

FOREIGN PATENT DOCUMENTS

GB 2434088 A 7/2007

* cited by examiner

*Primary Examiner* — Stephen Avila

(74) *Attorney, Agent, or Firm* — Osler, Hoskin & Harcourt LLP

(57) ABSTRACT

A watercraft has a deck connected to a hull, the deck having a wall, and a reboarding platform connected to at least one of the hull and the deck. The watercraft has a convertible seat assembly wherein a first panel is connected to the wall, and a second panel is movably connected to at least one of the wall, the reboarding platform and the first panel. The convertible seat assembly has a first configuration wherein the second panel is disposed on a reboarding platform side of the wall, and a second configuration wherein the first panel forms a generally vertical seat back and the second panel forms a generally horizontal seat bottom. A convertible seat assembly for a watercraft is also disclosed.

19 Claims, 13 Drawing Sheets

CONVERTIBLE SEAT ASSEMBLY FOR A WATERCRAFT

CROSS-REFERENCE

This application claims priority from U.S. Provisional Application No. 61/219,650, filed Jun. 23, 2009, the entirety of which is incorporated by reference.

FIELD OF THE INVENTION

The present invention relates to a convertible seat assembly for a watercraft.

BACKGROUND OF THE INVENTION

Many sport boats have a deck defining a passenger area, a hull connected to the deck, a reboarding platform at the rear, and a sunpad located between the reboarding platform and the passenger area. The sunpad is a padded element mounted on a pedestal, wide enough to accommodate one or more persons for resting or sunbathing thereon. The sunpad can be located above the engine with the pedestal containing a part of the engine which usually extends above the reboarding platform.

The reboarding platform is typically integrally formed with the deck. The reboarding platform allows passengers to reboard the watercraft from the water when the watercraft is not moving. The reboarding platform therefore has to be kept unobstructed.

It is common to see boat users seating on the reboarding platform, either for sunbathing, changing sport equipment. However, the reboarding platform is not equipped with furniture or seating facilities, and boat users have to seat or lie uncomfortably on the bare floor of the reboarding platform.

Therefore, there is a need for a boat having a seating facility on the reboarding platform which does not obstruct the reboarding platform when the seating facility is not in use.

SUMMARY OF THE INVENTION

It is an object of the present invention to ameliorate at least some of the inconveniences mentioned above.

It is also an object of the present invention to provide a convertible seat assembly having first and second configurations. In the first configuration, the convertible seat assembly is stowed, leaving the reboarding platform unobstructed, and in the second configuration, the convertible seat assembly forms a seat for the reboarding platform.

It is another object of the invention to provide a convertible seat assembly wherein, in the first configuration, the convertible seat assembly forms part of a sunpad, and in the second configuration, the convertible seat assembly forms a lounge chair.

It is an additional object of the invention to provide a boat having a convertible seat assembly.

In one aspect, the invention provides a watercraft having a hull, a deck connected to the hull, the deck having a wall, and a reboarding platform connected to at least one of the hull and the deck. The watercraft has a convertible seat assembly. The convertible seat assembly has a first panel connected to the wall, and a second panel movably connected to at least one of the wall, the reboarding platform and the first panel. The convertible seat assembly has first and second configurations. In the first configuration, the second panel is disposed on a reboarding platform side of the wall. In the second configuration, the first panel forms a generally vertical seat back and the second panel forms a generally horizontal seat bottom.

In an additional aspect, the first panel is pivotally connected to the wall. In the first configuration, the second panel supports at least partially the first panel generally horizontally above the reboarding platform to form a sunpad. In the second configuration the first panel rests at least partially along the wall and the second panel rests at least partially on the reboarding platform.

In a further aspect, a third panel is hingedly connected to the second panel. In the second configuration, the third panel rests at least partially on the reboarding platform.

In an additional aspect, the third panel has a handle.

In a further aspect, the third panel has two ends. In the second configuration, the end nearest to the wall is higher than the end furthest from the wall.

In an additional aspect, the third panel comprises one of a protrusion and a recess and the second panel comprises an other one of the protrusion and the recess. The protrusion mates with the recess when the convertible seat assembly is in the first configuration.

In a further aspect, the first panel has two ends. In the first configuration, the second panel and the third panel are disposed between the two ends of the first panel.

In an additional aspect, the second panel and the third panel have a wedge shape.

In a further aspect, the hinge between the second panel and the third panel is a live hinge made of one of non-corrosive metal, fabric, and polymer.

In an additional aspect, a third panel is slidably connected to the second panel. In the second configuration, the third panel rests at least partially on the reboarding platform.

In a further aspect, the second panel has a handle.

In an additional aspect, in the first configuration, the first panel rests at least partially on the second panel, and the second panel prevents downward rotation of the first panel.

In a further aspect, the second panel has two ends. In the second configuration, the end nearest to the wall is lower than the end furthest from the wall.

In an additional aspect, the first panel has two ends. In the first configuration, the second panel is disposed between the two ends of the first panel.

In a further aspect, the second panel is hingedly connected to at least one of the wall and the reboarding platform via a spring biasing the convertible seat assembly toward the first configuration.

In an additional aspect, at least one of the first panel and the second panel includes a cushion.

In a further aspect, the watercraft comprises two convertible seat assemblies.

In an additional aspect, the watercraft further comprises a passenger area is defined by the deck, the passenger area being separated at least partially from the reboarding platform by the wall. In the second configuration, the seat back faces away from the passenger area.

In another aspect, the invention provides a convertible seat assembly for a reboarding platform of a watercraft. The convertible seat assembly has a first panel adapted to be pivotally connected to a wall of the watercraft, and a second panel adapted to be movably connected to at least one of the wall, the reboarding platform and the first panel. The convertible seat assembly has first and second configurations. In the first configuration, the second panel supports at least partially the first panel generally horizontally above the second panel. In the second configuration, the first panel forms a generally vertical seat back and the second panel forms a generally horizontal seat bottom.

In an additional aspect, a third panel is hingedly connected to the second panel.

For the purpose of this application, the expression "platform connected to at least one of the hull and the deck" comprises a platform integrally formed with at least one of the hull and the deck. Also, terms related to spatial orientation such as upwardly, downwardly, front, rear, left, and right, are as they would normally be understood by a driver of the watercraft sitting therein in a normal driving position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

The present invention will be described with respect to a sport boat. However, it should be understood that other types of watercraft are contemplated.

Figure 1:
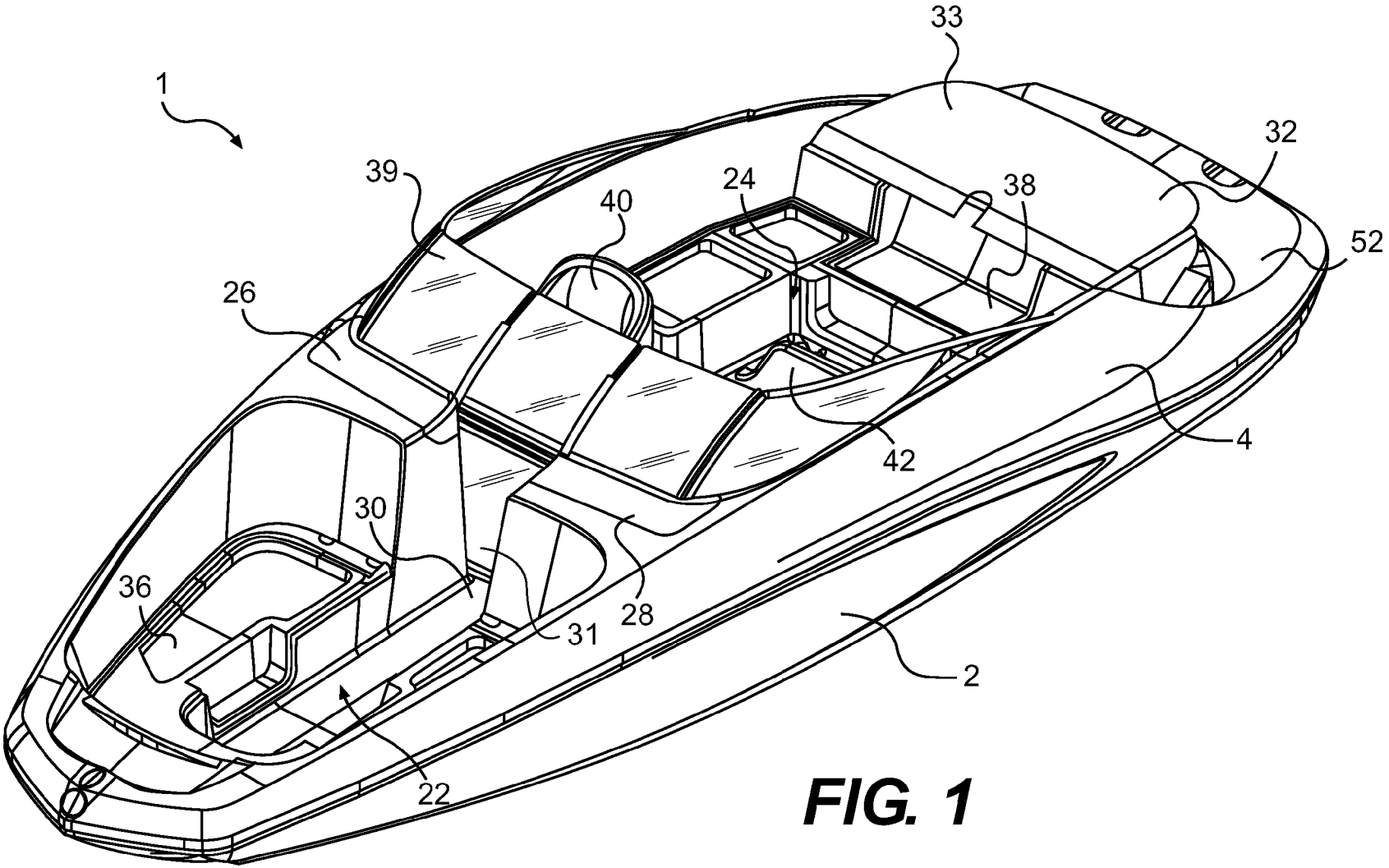
FIG. 1 is a front, left perspective view of a watercraft according to the present invention.
Figure 2:
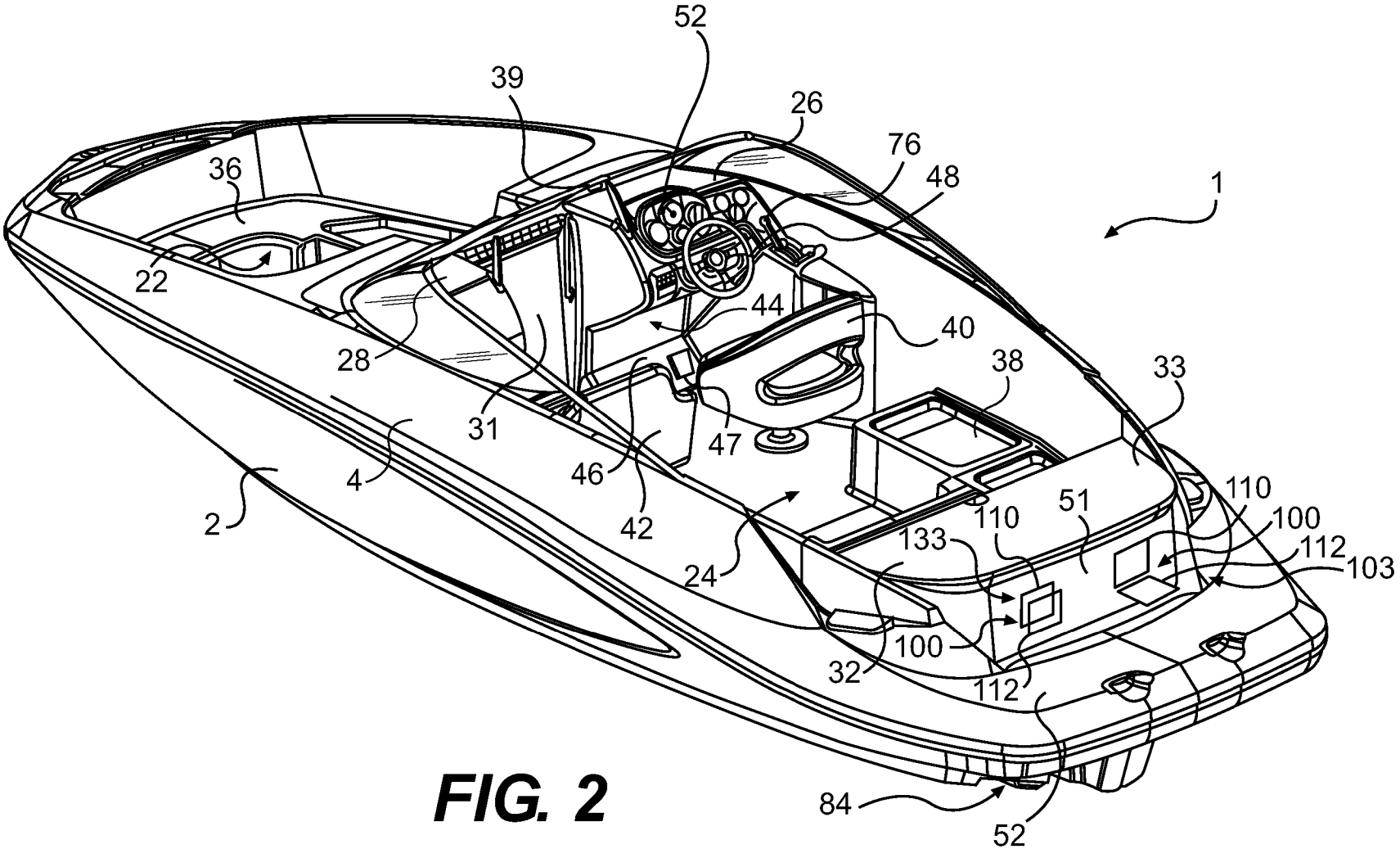
FIG. 2 is a rear, left perspective view of the watercraft of FIG. 1 with a schematic representation of a left convertible seat assembly in a stowed configuration and a right convertible seat assembly in a seating configuration.

As shown in FIGS. 1 and 2, a watercraft 1 has a hull 2 and a deck 4 supported by the hull 2. The deck 4 has a forward passenger area 22 located at a bow of the watercraft 1, and a rearward passenger area 24 located at an aft of the watercraft 1. A right console 26 and a left console 28 are disposed on either side of the deck 4 between the two passenger areas 22, 24. A passageway 30 disposed between the two consoles 26, 28 allows for communication between the two passenger areas 22, 24. A door 31 is used to selectively open and close the passageway 30.

The forward passenger area 22 has a C-shaped seating area 36 for passengers to sit on. The rearward passenger area 24 also has a C-shaped seating area 38 at the back thereof. A driver seat 40 facing the right console 26 and a passenger seat 42 facing the left console 24 are also disposed in the rearward passenger area 24. It is contemplated that the driver and passenger seats 40, 42 can swivel so that the passengers occupying these seats can socialize with passengers occupying the C-shaped seating area 38. A windshield 39 is provided at least partially on the left and right consoles 24, 26 and forwardly of the rearward passenger area 24 to shield the passengers sitting in that area from the wind when the watercraft 1 is in movement. The right and left consoles 26, 28 extend inwardly from their respective side of the boat 20. At least a portion of each of the right and the left consoles 26, 28 is integrally formed with the deck 4. The right console 26 has a recess 44 formed on the lower portion of the back thereof to accommodate the feet of the driver sitting in the driver seat 40 and an angled portion of the right console 26 acts as a footrest 46. A foot pedal 47 is provided on the footrest 46 which may be used to control the jet propulsion system 84 as described in greater detail below. The left console 28 has a similar recess (not shown) to accommodate the feet of the passenger sitting in the passenger seat 42. The right console 26 accommodates all of the elements necessary to the driver to operate the watercraft 1. These include, but are not limited to: a steering assembly including a steering wheel 48, a throttle operator 76 in the form of a throttle lever, and an instrument panel 52. The instrument panel 52 has various dials indicating the watercraft speed, engine speed, fuel and oil level, and engine temperature. It is contemplated that the elements attached to the right console 26 could be different than those mentioned above. The left console 28 incorporates a storage compartment (not shown) which is accessible to the passenger sitting the passenger seat 42.

A reboarding platform 52 located at the aft of the watercraft 1 is used for passengers to easily reboard the watercraft 1 from the water. It is contemplated that the reboarding platform 52 could instead be located at the bow of the watercraft 1. The reboarding platform 52 is integrally formed with the deck 4. Alternatively, the reboarding platform 52 could be separate from the deck 4 and be connected to the deck 4 or the hull 2. It is contemplated that the reboarding platform 52 could have more than one level, and that the reboarding platform 52 could be higher or lower than a floor of the deck 4. A retractable ladder (not shown) may be affixed to a transom 54 of the watercraft 1 to facilitate boarding the watercraft 1 from the water onto the reboarding platform 52. At least one engine (not shown) is located at the aft of the watercraft 1 between the hull 2 and the deck 4. The engine powers a jet propulsion system 84. It is contemplated that the watercraft 1 could have two engines and two jet propulsion systems 84. A sunpad 33 mounted on a pedestal 51 is located between the rearward passenger area 24 and the reboarding platform 52. The sunpad 33 is used by passengers to sunbathe thereon while the watercraft 1 is not in motion. When located above the engine, the sunpad 33 also acts as an engine cover 32. It is contemplated that the sunpad 33 could be located at the bow of the watercraft 1 if the reboarding platform 52 were also to be located at the bow of the watercraft 1.

Referring to FIG. 2, a convertible seat assembly 100 for the reboarding platform 52 of the watercraft 1 will be described. The watercraft 1 comprising two identical convertible seat assemblies 100, for simplicity only one convertible seat assembly 100 will be described.

The convertible seat assembly 100 comprises a first panel 110 and a second panel 112. The first panel 110 is fixed to a side (or wall) of the pedestal 51 facing the reboarding platform 52. The second panel 112 is hinged to that same side of the pedestal 51, underneath the first panel 110. Alternatively, the second panel 112 could be hinged to the first panel 110 or to the reboarding platform 52. The first panel 110 and the second panel 112 are square shaped cushions mounted on rigid boards. It is contemplated that the first panel 110 and the second panel 112 could be of another shape, such as a rectangle.

In a stowed configuration 133 (shown in FIG. 2, left side), the second panel 112 is disposed along the first panel 110 in a generally vertical position. In this configuration, the convertible seat assembly 100 is not in use, and the reboarding platform 52 is unobstructed. In a seating configuration 103 (shown in FIG. 2, right side), the second panel 112 is generally perpendicular to the first panel 110, and forms a seat bottom, while the first panel 110 stays in a generally vertical position, and forms a seat back.

To convert the convertible seat assembly 100 from the stowed configuration 133 to the seating configuration 103, a user rotates the second panel 112 downwardly, away from the first panel 110, until the second panel 112 reaches a generally horizontal position. To convert the convertible seat assembly 100 from the seating configuration 103 to the stowed configuration 133, the user rotates the second panel 112 back toward the pedestal 51 and the first panel 110, until reaching a generally vertical position.

It is contemplated that, the second panel 112 could be hinged to the pedestal 51 via a biased hinge which would bias the convertible seat assembly 100 toward the stowed configuration 133 when a person gets off the second panel 112. It is also contemplated that, the first panel 110 could be hinged to the pedestal 51, so as to allow the first panel 110 to form an inclined seat back when the convertible seat assembly 100 is in the seating configuration 103.

Figure 3:
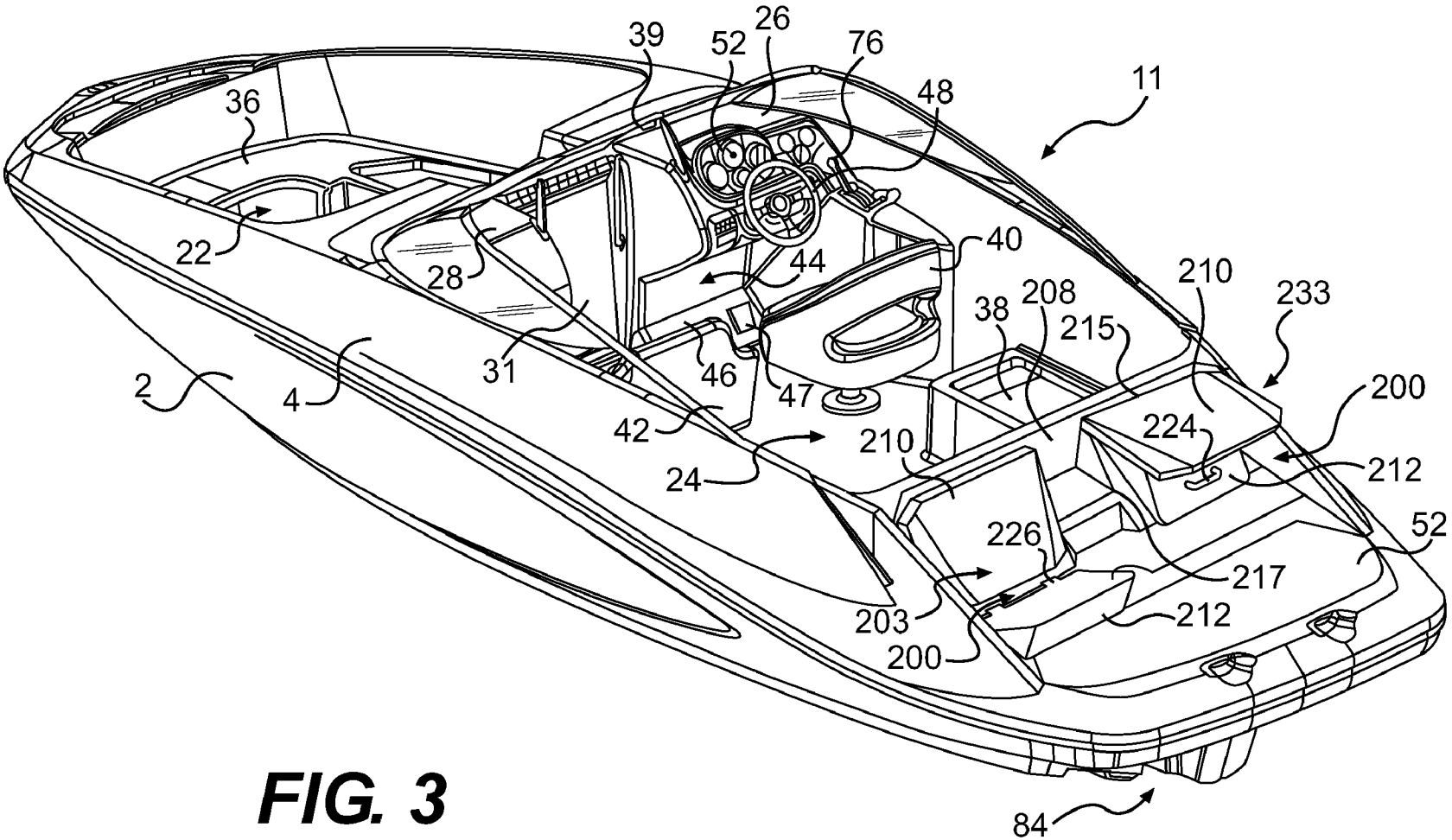
FIG. 3 is a rear, left perspective view of a watercraft according to another embodiment with a left convertible seat assembly in a seating configuration, and a right convertible seat assembly in a stowed or sunpad configuration.
Figure 4:
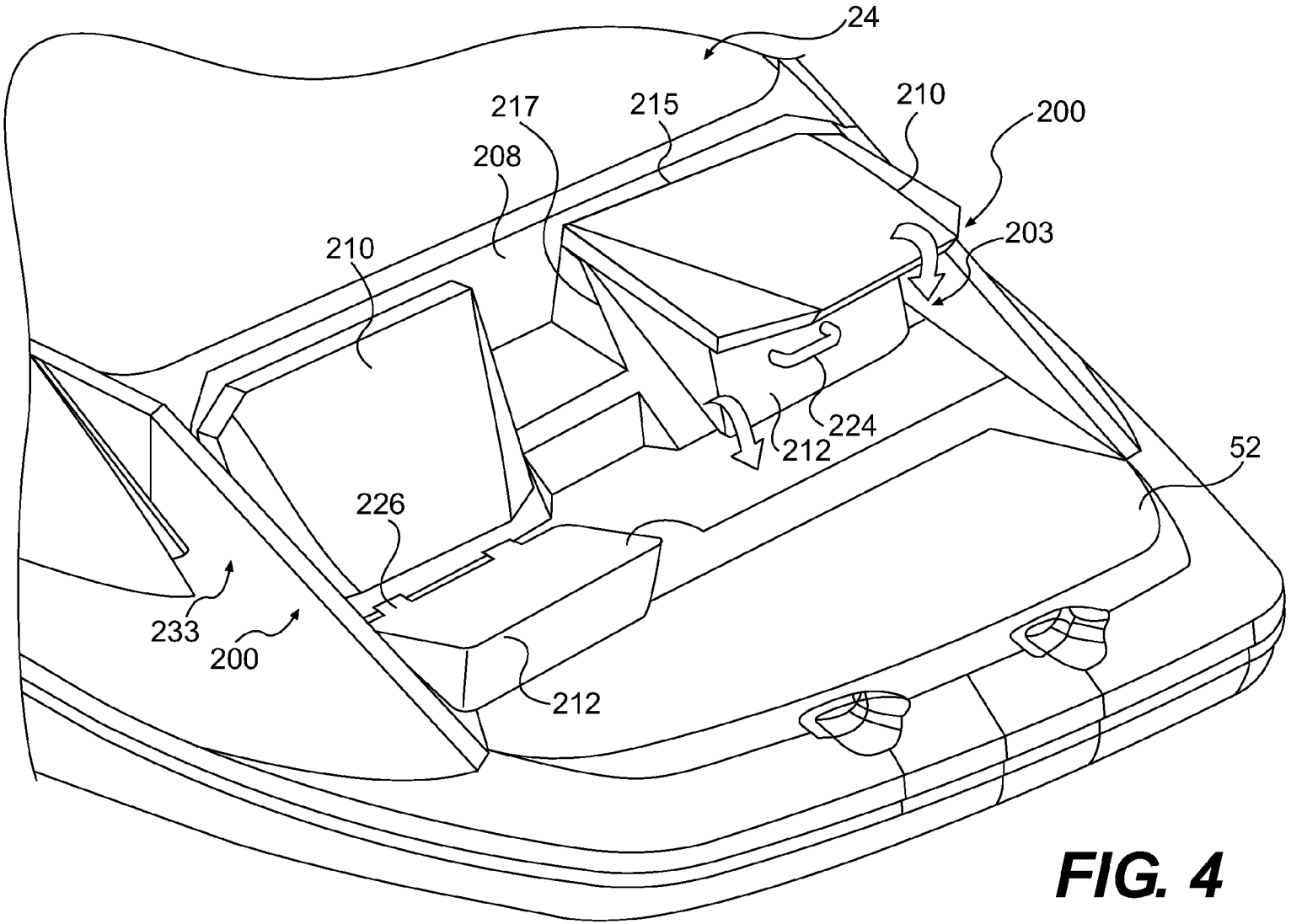
FIG. 4 is a close-up view of the two convertible seat assemblies of FIG. 3.

Turning now to FIGS. 3 and 4, a convertible seat assembly 200 for a watercraft 11 will be described. The watercraft 11 comprising two identical convertible seat assemblies 200, for simplicity only one convertible seat assembly 200 will be described. The watercraft 11 comprises generally the same features as the watercraft 1. The common features of the watercraft 1 and 11 have been given the same reference numerals and will not be described again. The watercraft 11 differs with the watercraft 1 by the absence of the pedestal 51 and the sunpad 33. In the watercraft 11, the rearward passenger area 24 is separated from the reboarding platform 52 by a wall 208. It is contemplated that the watercraft 11 could not comprise the wall 208 and that the rearward passenger area 24 would be separated from the reboarding platform 52 by the C-shaped seating area 38, a back of which would serve as the wall 208 for the purposes of mounting the convertible seat assemblies 200.

The convertible seat assembly 200 comprises a first panel 210 and a second panel 212. Both panels are moveable between positions where the convertible seat assembly 200 provides a seating configuration 203, and positions where the convertible seat assembly 200 forms a rest bench (or stowed configuration 233). In the stowed configuration 233, the first panel 210 forms a generally horizontal pad, and the second panel 212 forms a generally vertical pedestal which supports the first panel 210 generally horizontally. In the seating configuration 203, the first panel 210 forms a seat back, and the second panel 212 forms a seat bottom.

The two convertible seat assemblies 200 form two rest benches in the stowed configuration 233, and two seats in the seating configuration 203. It is contemplated that if the two convertible seat assemblies 200 were positioned adjacent to each other in a side-by-side relationship, the two convertible seat assemblies 200 would form, in the stowed configuration 233, a sunpad instead of two separate rest benches. Alternatively, if the two convertible seat assemblies 200 were mounted on the pedestal 51 of the watercraft 1, the sunpad or the rest benches formed by the convertible seat assemblies 200 in the stowed configuration 233 would be contiguous to the sunpad 33 of the watercraft 1 and would form a single extended sunpad.

The first panel 210 is pivotally connected via a hinge 215 to a corner of a top of the wall 208. It is contemplated that, the hinge 215 could be positioned at a different location on the wall 208. The hinge 215 allows to move the first panel 210 between a generally horizontal pad position (shown in FIG. 3, right side) when the convertible seat assembly 200 is in the sunpad configuration 233, and a generally vertical seat back position (shown in FIG. 3, left side) when the convertible seat assembly 200 is in a seating configuration 203. A bottom of the first panel 210 comprises a groove (not shown) which accommodates an end of the second panel 212 such that the groove locks the convertible seat assembly 200 when in the stowed configuration 233. The groove helps to maintain the convertible seat assembly in the stowed configuration 233 despite vibrations or motion of the watercraft 11 during cruising. It is contemplated that the bottom of the first panel 210 could comprise a protrusion instead of the groove, and that the protrusion would retain by abutment the second panel 212 in the generally vertical pedestal position when the convertible seat assembly 200 is in the stowed configuration 233. The first panel 210 preferably has a cushioned top (not shown) for added comfort and a rigid board (not shown) for enhanced rigidity. The cushioned top of the first panel 210 is preferably provided with waterproof lining.

The second panel 212 is hinged to the wall 208. It is contemplated that the second panel 212 could be hinged to the reboarding platform 52. The second panel 212 is preferably hinged near a bottom of the wall 208, such that the second panel 212 rests on the reboarding platform 52 when the convertible seat assembly 200 is in the seating configuration 203. The second panel 212 pivots between a substantially vertical position, where the second panel 212 rests along the wall 208

(stowed or sunpad configuration 233), and a generally horizontal position where the second panel 212 rests onto the reboarding platform 52 (seating configuration 203). The second panel 212 has a shape complementary with an inclined protrusion 217 of the wall 208 so as to provide support to the first panel 210 when the convertible seat assembly 200 is in the stowed configuration 233. In addition, when the convertible seat assembly 200 is in the seating configuration 203, the inclined protrusion 217 provides a reclined orientation to the first panel 210. It is contemplated that the wall 208 could not comprise the inclined protrusion 217 and that the shape of the first panel 210 and the second panel 212 would be modified accordingly. The second panel 212 has a handle 224 to grab the convertible seat assembly 200 during conversion of the convertible seat assembly 200. The second panel 212 is angled slightly upwardly for comfortably accommodating the back of thighs of the user when the convertible seat assembly 200 is in the seating configuration 203. The second panel 212 connects to the wall 208 preferably via a biased hinge 226 which slows down the falling of the second panel 212 when the convertible seat assembly 200 is being moved from the stowed configuration 233 to the seating configuration 203. The biased hinge 226 preferably has a set opening angle in order to provide a desired inclination to accommodate the thighs of the user when the convertible seat assembly 200 is in the seating configuration 203. The second panel 212 also comprises a cushioned top for added comfort, which is preferably provided with waterproof lining.

To convert the convertible seat assembly 200 from the stowed position 233 to the seating configuration 203, and with arrows indicating a direction of motion in FIG. 4, the user rotates the first panel 210 upwardly slightly above the generally horizontal pad position in order to separate and unlock the second panel 212 from the groove in the first panel 210. The user then pivots the second panel 212 downwardly toward the reboarding platform 52 to form the seat bottom, while the first panel 210 pivots by itself or with the help of the user, toward the wall 208 to form the seat back.

To stow the convertible seat assembly 200, the user rotates the first panel 210 upwardly until the generally horizontal pad position is reached, and rotates the second panel 212 upwardly toward the wall 208 until the generally vertical pedestal position is reached. The user then continues to rotate the first panel 210 until slightly above the generally horizontal pad position, and adjusts the second panel 212 between ends of the first panel 210 into the groove of the first panel 210. When the second panel 212 is adjusted into the groove of the first panel 210, the convertible seat assembly 200 is locked into the sunpad configuration 233.

Figure 5:
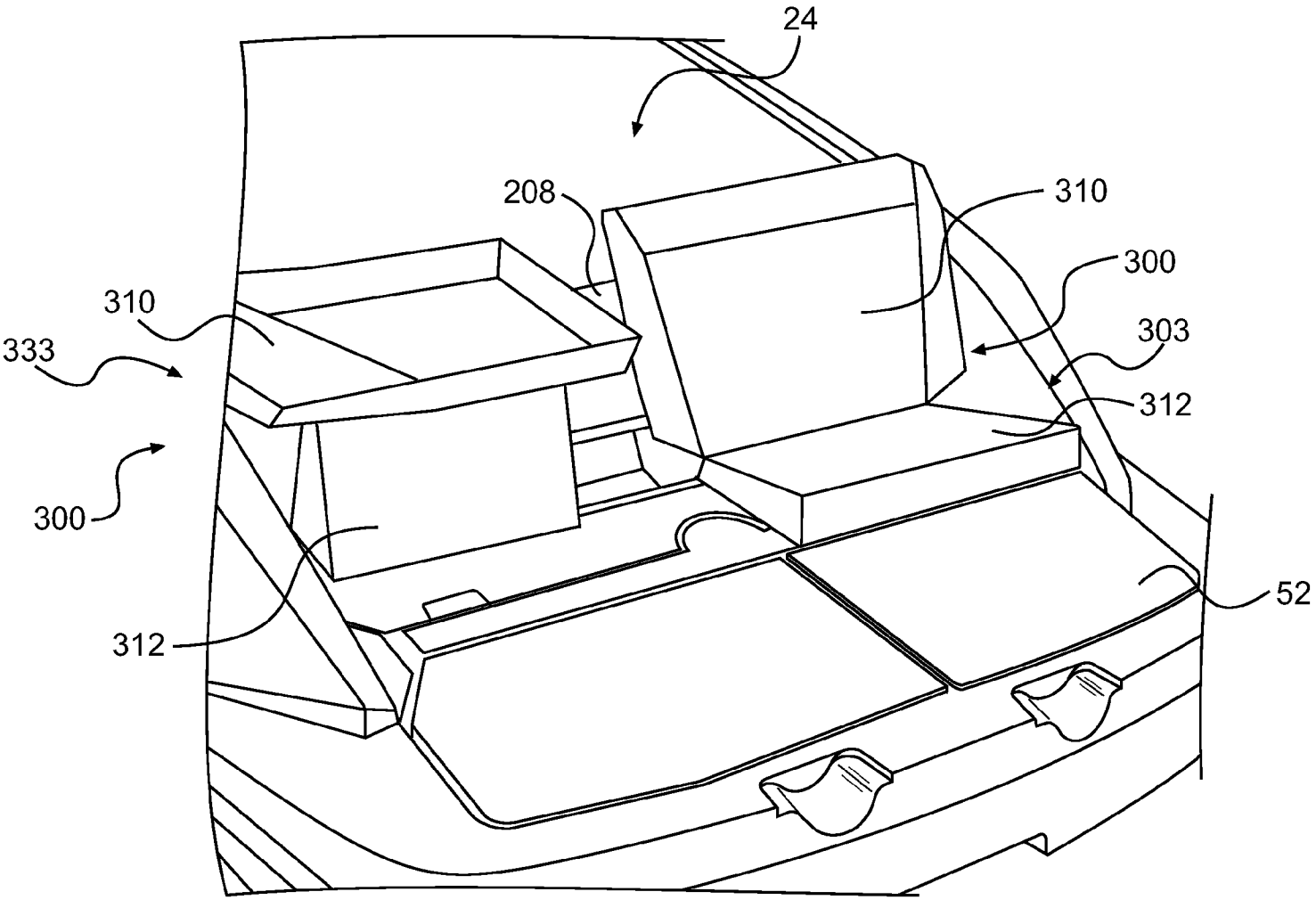
FIG. 5 is a perspective view of two convertible seat assemblies according to yet another embodiment with a left convertible seat assembly in a stowed or sunpad configuration, and a right convertible seat assembly in a seating configuration.
Figure 6:
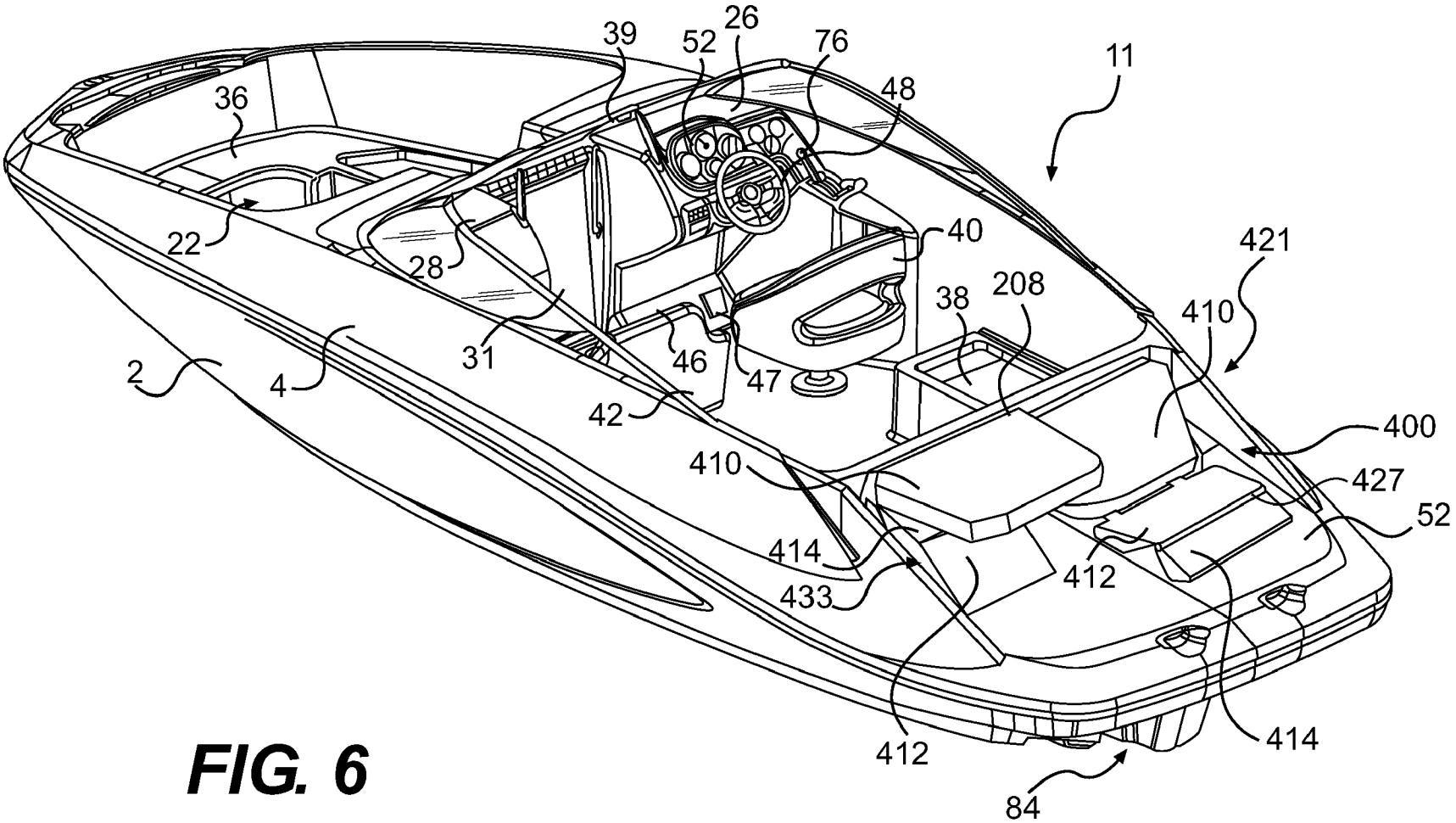
FIG. 6 is a rear, left perspective view of a watercraft according to another embodiment with a right convertible seat assembly in a lounge seating configuration, and a left convertible seat assembly being in a stowed or sunpad configuration.
Figure 7:
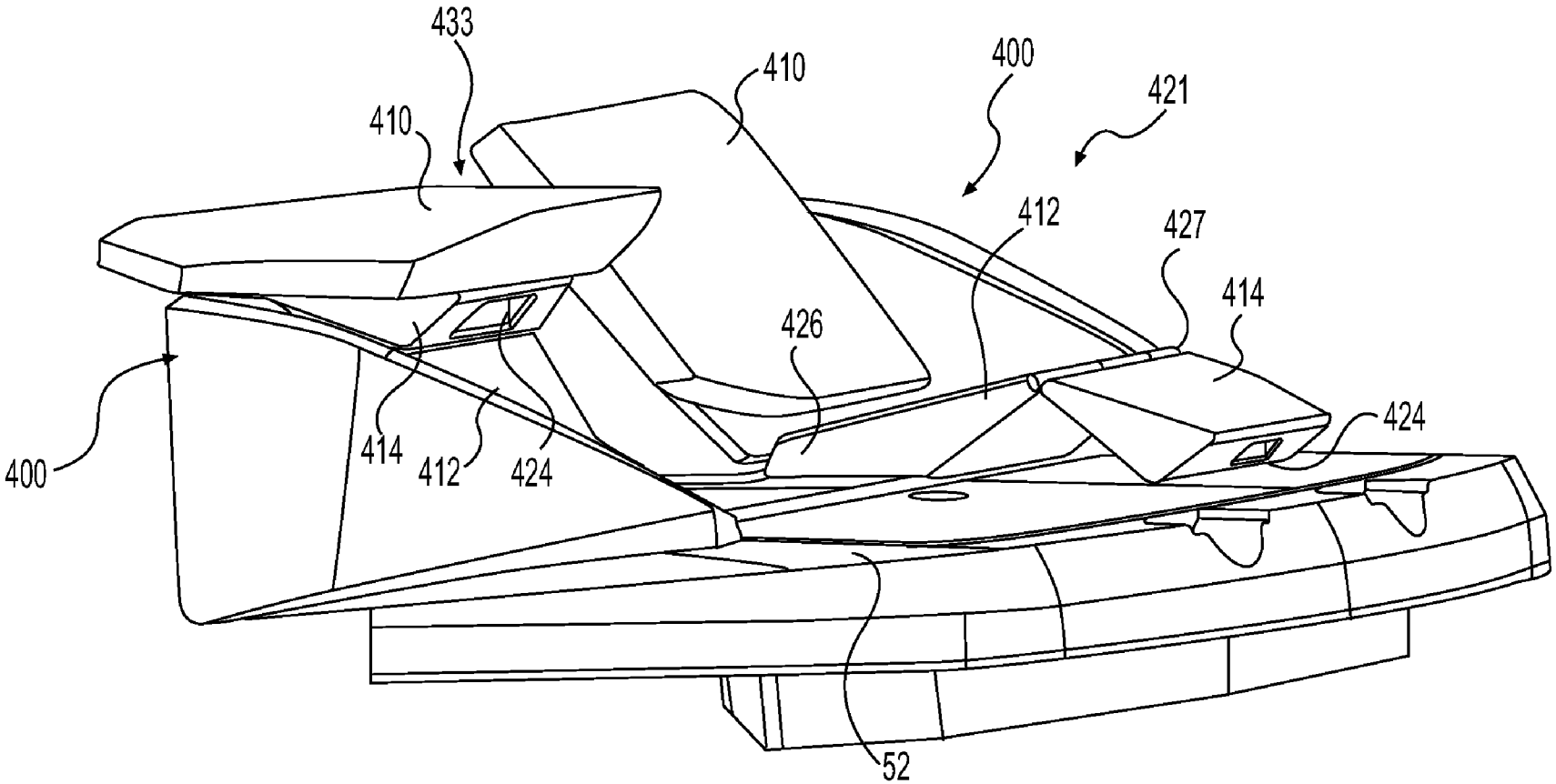
FIG. 7 is a close-up view of the two convertible seat assemblies of FIG. 6.

Turning now to FIG. 5, another convertible seat assembly 300 for the watercraft 11 will be described. It is contemplated that the convertible seat assembly 300 could alternatively be mounted to the side of the pedestal 51 of the watercraft 1 facing the reboarding platform 52.

The convertible seat assembly 300 comprises a first panel 310 hinged to the wall 208, and a second panel 312 pivotally connected via a live hinge (not shown) to the first panel 310. The live hinge could be made of non-corrosive metal, fabric, or polymer. Similarly to the convertible seat assembly 200, the first panel 310 is hinged to the wall 208 which faces the reboarding platform 52. The first panel 310 can be pivoted from a generally horizontal pad position to a generally vertical seat back position. A groove (not shown) in the reboarding platform 52 is used to accommodate an end of the second panel 312 when the convertible seat assembly 300 is in a stowed configuration 333 for locking and maintaining the convertible seat assembly 300 in a stowed configuration 333 despite vibrations or motion of the watercraft 11 during cruising. It is contemplated that the reboarding platform 52 could comprise a protrusion instead of a groove such as to retain by abutment the second panel 312 in a generally vertical pedestal position when the convertible seat assembly 300 is in the stowed configuration 333.

To convert the convertible seat assembly 300 to the stowed or sunpad configuration 333, the user rotates the first panel 310 until a position slightly above the generally vertical pad position. By lifting the first panel 310, the user lifts the second panel 312. Once rotated, the user positions the second panel 312 underneath the first panel 310 into the groove in the reboarding platform 52. In that position, the second panel 312. forms a generally vertical pedestal which supports the first panel 310 in a generally horizontal pad position.

To convert the convertible seat assembly 300 into a seating configuration 303, the user grabs the second panel 312, and pivots the panels 310 and 312 until the first panel 310 is positioned along the side of the wall 208, and the second panel 312 is positioned on the reboarding platform 52. In that configuration, the first panel 310 forms a seat back and the second panel 312 forms a seat bottom.

Turning now to FIGS. 6 to 11, another convertible seat assembly 400 for the watercraft 11 will be described. The watercraft 11 comprising two identical convertible seat assemblies 400, for simplicity only one convertible seat assembly 400 will be described. The two convertible seat assemblies 400 are adjacent, and together form, in the stowed (or sunpad) configuration 433, a sunpad which leaves the reboarding platform 52 unobstructed. Alternatively, the two convertible seat assemblies 400 could be connected to the side of the pedestal 51 of the watercraft 1 facing the reboarding platform 52, and form with the sunpad 33, in the stowed configuration 433, an extended sunpad.

The convertible seat assembly 400 comprises a first panel 410 similar to the first panel 210, a second panel 412 similar to the second panel 212, and a third panel 414. Features of the first panel 410 and the second panel 412 that are common to the first panel 210 and the second panel 212 will not be repeated. The presence of the third panel 414 allows the convertible seat assembly 400 to have a lounge seating configuration 421 instead of the seating configuration 203. When the convertible seat assembly 400 is in the lounge seating configuration 421, the third panel 414 acts as a leg rest, while the second panel 412 acts as a seat bottom, and the first panel 410 as a back rest. In the stowed configuration 433, the first panel 410 acts as a sunpad, and the second panel 412 and the third panel 414 act as a pedestal to support to the first panel 410 into a generally horizontal position.

The third panel 414 is smaller than the second panel 412 and has a shape complementary to the shape of the second panel 412. Furthermore, an assembly of the second panel 412 and the third panel 414 has a shape complementary with the inclined protrusion 217 of the wall 208. The inclined protrusion 217 provides support to the second panel 412 and the third panel 414 when the convertible seat assembly 400 is in the stowed configuration 433, and positions the first panel 410 as a reclined seat back when the convertible seat assembly 400 is in the lounge seating configuration 421. It is contemplated that the wall 208 could not comprise the inclined protrusion 217 and that the shape of the first panel 410, the second panel 412, and the third panel 414 would be modified accordingly.

A live hinge 427 of non-corrosive metal, fabric, or polymer connects the third panel 414 to the second panel 412. The live hinge 427 has a set opening angle so as to keep the second panel 412 and the third panel 414 inclined relative to each other in order to accommodate thighs and calves, respectively, of the user, when the convertible seat assembly 400 is in the lounge seating position 421. When in the convertible seat assembly 200 the second panel 212 comprises the handle 224, in the convertible seat assembly 400, the third panel 414 instead comprises a handle 424 integrally formed therein to ease conversions of the seat assembly 400.

Figure 8:
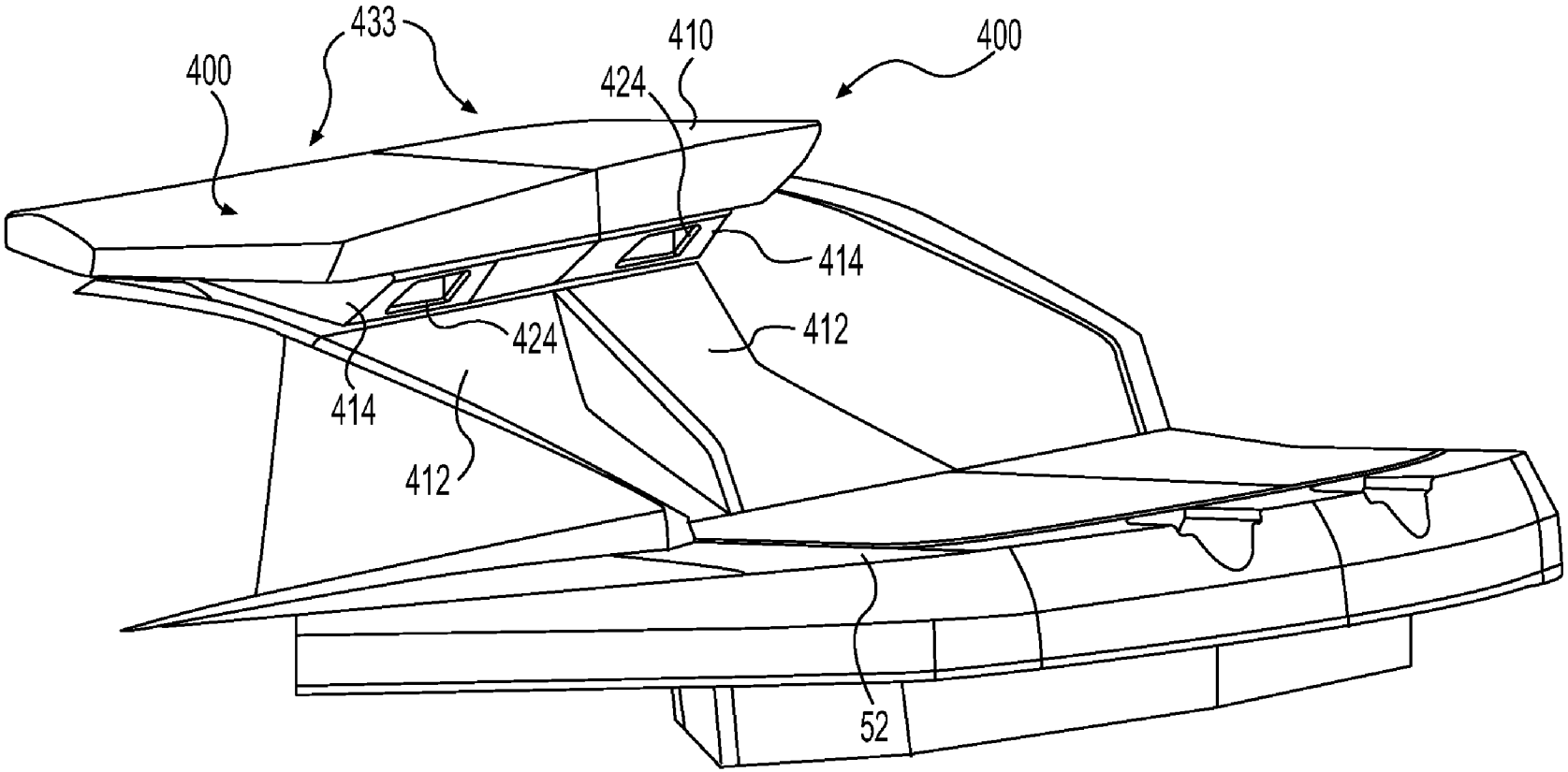
FIG. 8 is a close-up view of the two convertible seat assemblies of FIG. 7 both in the stowed or sunpad configuration.

As shown in FIG. 8, in the stowed or sunpad configuration 433, the two convertible seat assemblies 400 form a single sunpad. Alternatively, if the two convertible seat assemblies 400 were apart, they would form, in the stowed configuration 433, two rest benches. It is contemplated that the two convertible seat assemblies 400 could be separated by a padded section, such that the padded section acts as a bridge between the two convertible seat assemblies 400 in order to form a single extended sunpad in the stowed configuration 433.

To convert the convertible seat assembly 400 from the sunpad configuration 433 to the lounge seating configuration 421, the user rotates the first panel 410 slightly above a generally horizontal pad position in order to unlock the second panel 412 from the groove of the first panel 410. The user then rotates the second panel 412 and the third panel 414 toward the reboarding platform 52 until they both reach a generally horizontal position. Meanwhile, the first panel 410 is rotated downwardly toward the wall 208 to reach a generally vertical seat back position. The third panel 414 is finally adjusted with respect to the second panel 412 to form an angle with the second panel 412 for accommodating legs of the user To convert the convertible seat assembly 400 from the lounge seating configuration 421 to the sunpad configuration 433, the user folds the third panel 414 below the second panel 412 and forms a second panel-third panel assembly. The first panel 410 is rotated upwardly toward a generally horizontal pad position, while the assembly is rotated upwardly against the inclined protrusion 217 of the wall 208. The user continues to rotate the first panel 410 until a position slightly above the generally horizontal pad position. The second panel-third panel assembly is then adjusted between ends of the first panel 410 into the groove of the bottom of the first panel 410. Once adjusted, the first panel 410 rests solidly is a locked position on an end of second panel 412. The second panel-third panel assembly, when in the generally vertical position, forms a pedestal to the sunpad formed by the first panel 410.

Figure 9:
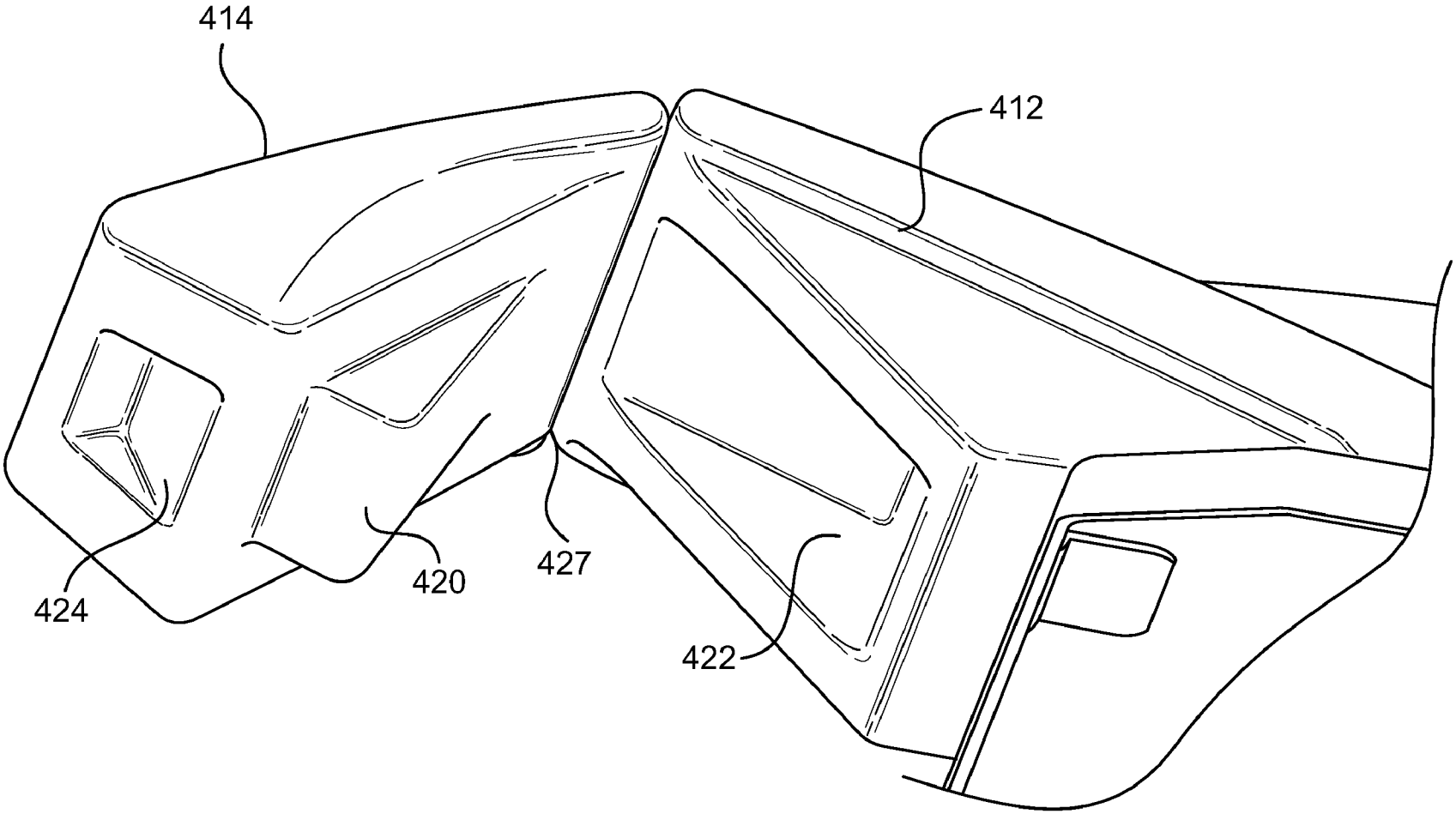
FIG. 9 is a bottom view of second and third panels of a convertible seat assembly according to an alternative embodiment of the convertible seat assembly of FIG. 6.

Referring to FIG. 9, in an alternative embodiment of the convertible seat assembly 400, the third panel 414 comprises a protrusion 420 mating with a recess 422 in the second panel 412 when the convertible seat assembly 400 is in the stowed configuration 433. The mating of the protrusion 420 into the recess 422 prevents lateral movement when the second panel 412 and the third panel 414 are assembled. It is contemplated that the second panel 412 could comprise the protrusion 420 and the third panel 414 could comprise the recess 422.

Figure 10:
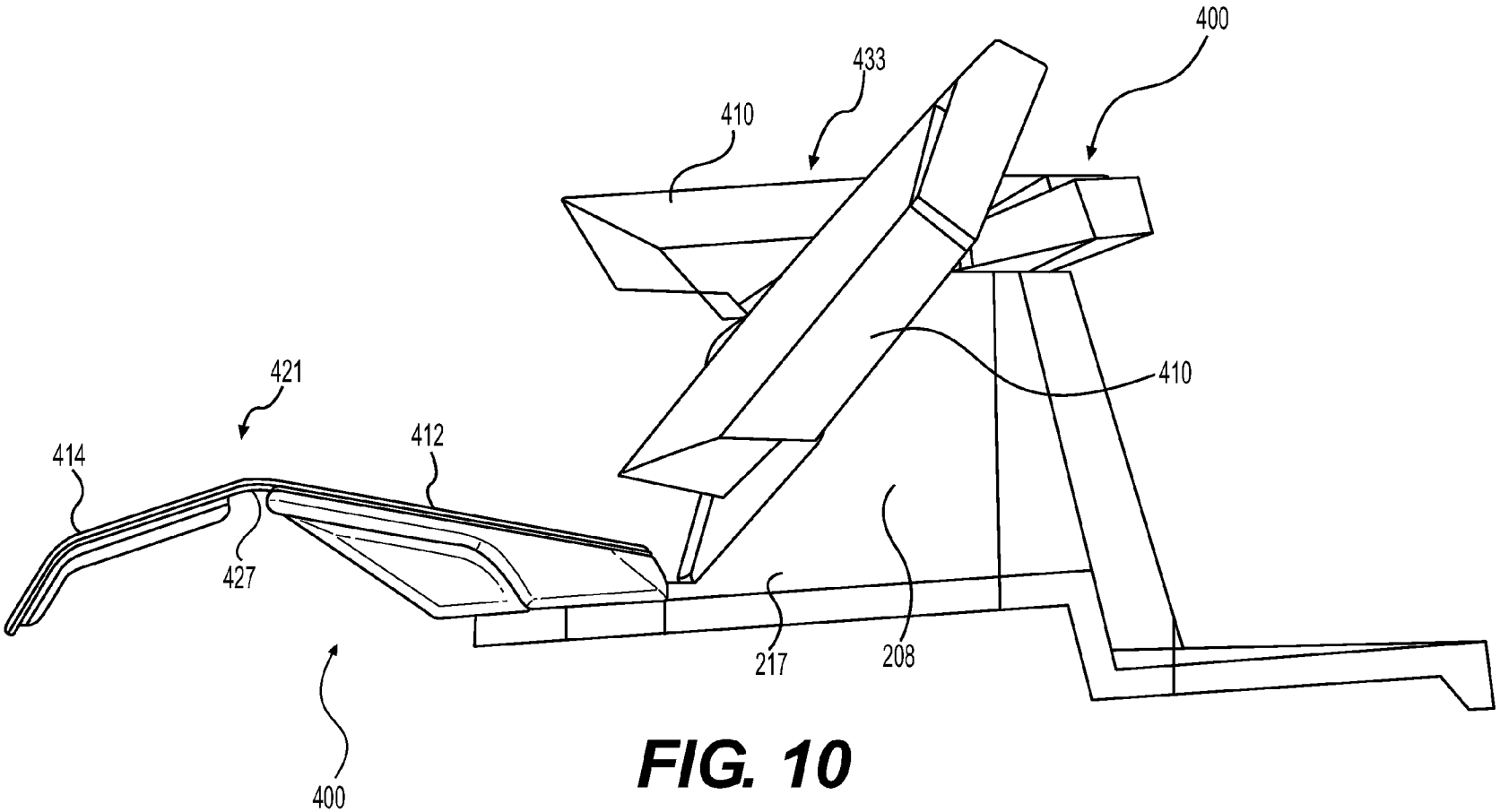
FIG. 10 is a side elevation view of two convertible seat assemblies according to an alternative embodiment of the convertible seat assembly of FIG. 6 with the left convertible seat assembly in a stowed or sunpad configuration, and the right convertible seat assembly in a lounge seating configuration.

Referring now to FIG. 10, an alternative embodiment of the convertible seat assembly 400 comprises a third panel 414 being a thin panel. The third panel 414 does not provide support to the first panel in the stowed configuration 433. Although the third panel 414 forms part of the pedestal in the stowed configuration 433, the structural support to the first panel 410 in that configuration is mainly provided by the second panel 412.

Figure 11:
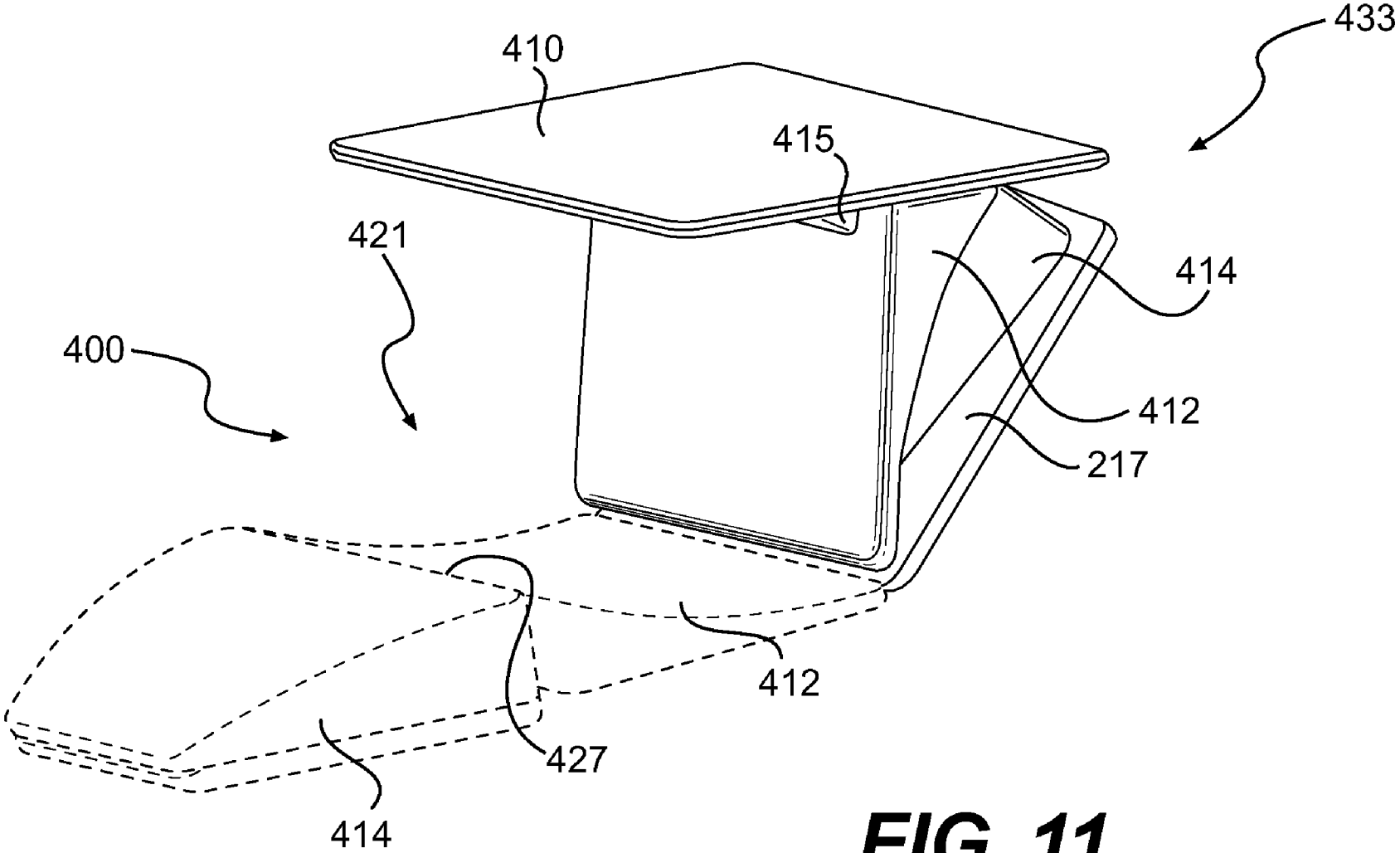
FIG. 11 is a perspective view of a convertible seat assembly according to another alternative embodiment of the convertible seat assembly of FIG. 6, with a lounge seating configuration shown in phantom.

Referring to FIG. 11, in another alternative embodiment of the convertible seat assembly 400, the second panel 412 and the third panel 414 have wedge shapes so as to provide a concave seat bottom and a convex leg rest without the need of the reduced opening angle live hinge 427 between the second panel 412 and the third panel 414. The bottom of the first panel 410 comprises a protrusion 415 in place of the groove in the previously presented embodiments of the convertible assembly 400. The protrusion 415 abuts the end of the second panel 412 when the convertible seat assembly 400 is in the sunpad configuration 433. In the lounge seating configuration 421 (shown in phantom in FIG. 11), the second panel 412 and the third panel 414 lay flat on the reboarding platform 52, and the inclination of the second panel 412 and the third panel 414 is given by the shape of the wedges themselves. The wedges have complementary shapes such that the third panel 414 is folded on top of the second panel 412 to form a compact pedestal.

Figure 12:
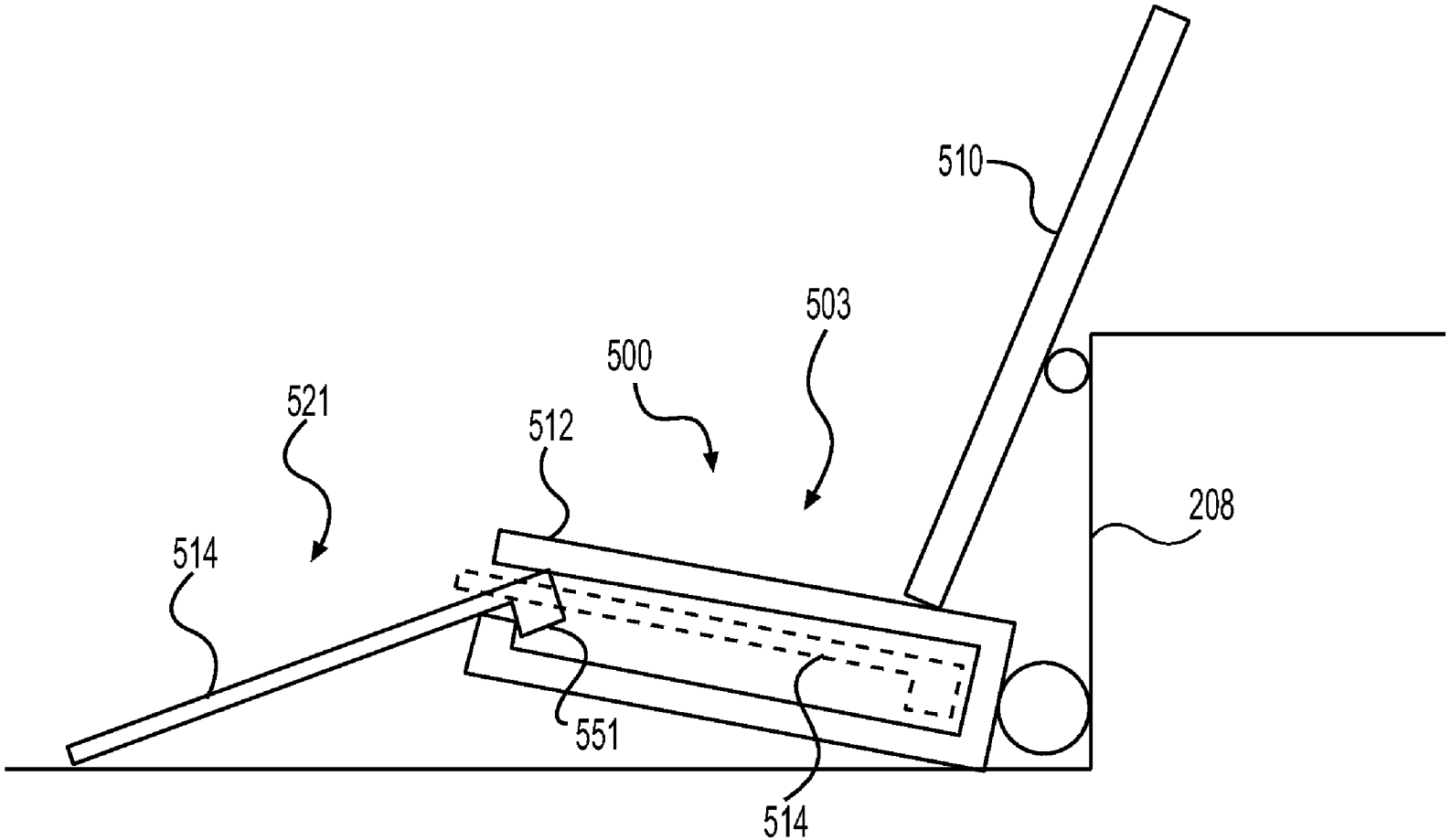
FIG. 12 is a schematic side elevation view of a convertible seat assembly according to yet another embodiment shown in a seating configuration, with a lounge seating configuration shown in solid lines.

Turning now to FIG. 12, another convertible seat assembly 500 for the watercraft 11 will be described. Alternatively, the convertible seat assembly 500 could be mounted to the pedestal 51 of the watercraft 1.

The convertible seat assembly 500 comprises a first panel 510, a second panel 512, and a third panel 514. The panels 510 and 512 are similar to, and operate in the same manner as panels 410 and 412, respectively. Therefore, features of the first panel 510 and the second panel 512, common to the first panel 410 and the second panel 412 respectively will not be repeated. The third panel 514, however, is slidably connected to the second panel 512. The third panel 514 is an optional leg rest. Hence the convertible seat assembly 500 forms a seat when the third panel 514 is slid inside the second panel 512, and a lounge chair when the third panel 514 is slid out the second panel 512.

To convert the convertible seat assembly 500 from a stowed position to a seating position 503, the first panel 510 and the second panel 512 are operated similarly to the first panel 410 and the second panel 412. To obtain the leg rest, converting the convertible seat assembly 500 from a seating configuration 503 to a lounge seating configuration 521, the user slides the third panel 514 out of the second panel 512 until a knob 551 abuts a ledge in the second panel 512, and rotates the third panel 514 downwardly to position an end of the third panel 514 onto the reboarding platform 52. The position of the third panel 514 achieves an ergonomic inclination with respect to the second panel 512. If the user does not wish to use the leg rest and wants to convert the convertible seat assembly 500 from the lounge seating configuration 521 back to the seating configuration 503, the user slides the third panel 514 back inside the second panel 512 (shown in phantom). It is contemplated that the second panel 512 and the third panel 514 could be slidably connected in a different manner. For example, the third panel 514 could be slid over the second panel 512.

Figure 13:
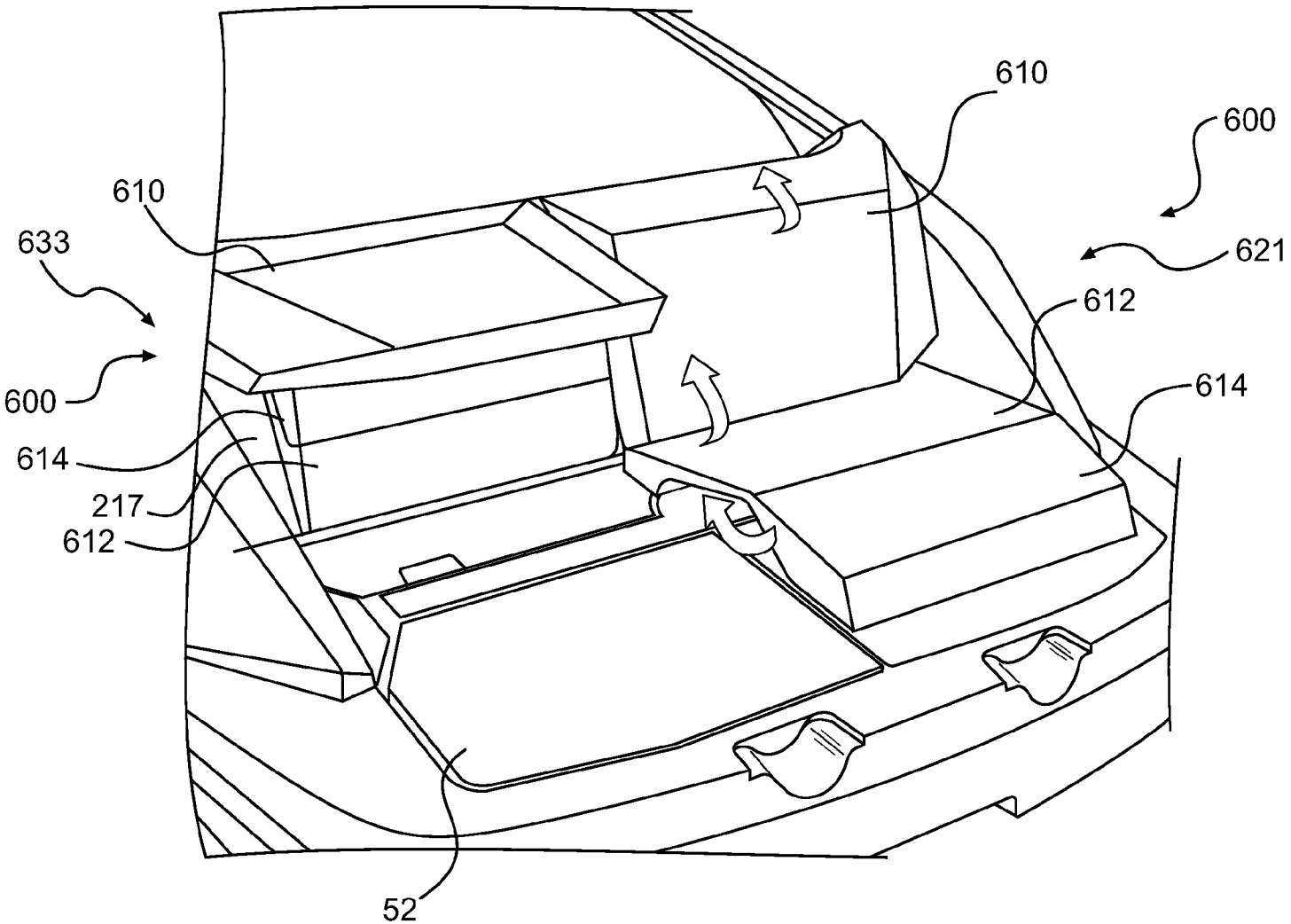
FIG. 13 is a perspective view of two convertible seat assemblies according to yet another embodiment with a left convertible seat assembly in a stowed or sunpad configuration, and a right convertible seat assembly in a lounge seating configuration.

Turning now to FIG. 13, another convertible seat assembly 600 for the watercraft 11 will be described. Alternatively, the convertible seat assembly 600 could be mounted to the pedestal 51 of the watercraft 1. A first panel 610 is pivotally connected to the wall 208. A second panel 612 is pivotally connected to the first panel 610, and a third panel 614 is pivotally connected to the second panel 612. The panels 610, 612, and 614 are connected together, and conversion of the seat assembly 600 is achieved by folding and unfolding the panels with respect to each other. It is contemplated that the wall 208 could comprise the inclined protrusion 217 and that the shapes of the panels 610, 612 and 614 would be modified accordingly. The reboarding platform 52 comprises a groove (not shown) to accommodate an end of the second panel 612 when the convertible seat assembly 600 is in a stowed or sunpad configuration 633. Alternatively, the reboarding platform 52 could comprise a protrusion on which the second panel 612 could abut.

To convert the convertible seat assembly 600 from a lounge seating configuration 621 to the sunpad configuration 633, and with arrows indicating direction of motion, the third panel 614 is pivoted downwardly to fit under the second panel 612 to form a second panel-third panel assembly. The second panel-third panel assembly is then pivoted toward the wall 208 until a generally vertical position is reached, while the first panel 610 is pivoted away from the wall 208 into a generally horizontal position to allow the second panel-third panel assembly to be positioned underneath the first panel 610. The second panel-third panel assembly is then adjusted into the groove of the reboarding platform 52 in order to give the first panel 610 support.

To convert the convertible seat assembly 600 from the sunpad configuration 633 to the lounge seating configuration 621, the user rotates the first panel 610 slightly above a generally horizontal position in order to free the end of the second panel 612 from the groove of the reboarding platform 52. The first panel 610 is then pivoted toward the wall 208 until reaching a generally vertical seat back position, while the second panel 612 and the third panel 614 are pivoted away from the wall 208 toward the reboarding platform 52 until reaching a generally horizontal seat bottom and leg rest position.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A watercraft comprising:

a hull;

a deck connected to the hull, the deck having a wall;

a reboarding platform connected to at least one of the hull and the deck; and a convertible seat assembly comprising:

a first panel pivotally connected to the wall; and a second panel movably connected to at least one of the wall, the reboarding platform and the first panel, the convertible seat assembly having first and second configurations, in the first configuration the second panel being disposed on a reboarding platform side of the wall in a generally vertical position, the second panel supporting at least partially the first panel generally horizontally above the reboarding platform, and in the second configuration the first panel resting at least partially along the wall and the second panel resting at least partially on the reboarding platform, the first panel forming a generally vertical seat back and the second panel forms a generally horizontal seat bottom.

2. The watercraft of claim 1, wherein the convertible seat assembly further comprises a third panel hingedly connected to the second panel; and wherein in the second configuration the third panel rests at least partially on the reboarding platform.

3. The watercraft of claim 2, wherein the third panel has a handle.

4. The watercraft of claim 2, wherein the third panel has two ends; and wherein in the second configuration, the end nearest to the wall is higher than the end furthest from the wall.

5. The convertible seat assembly of claim 2, wherein the third panel comprises one of a protrusion and a recess and the second panel comprises an other one of the protrusion and the recess, the protrusion mating with the recess when the convertible seat assembly is in the first configuration.

6. The watercraft of claim 2, wherein the first panel has two ends; and wherein in the first configuration the second panel and the third panel are disposed between the two ends of the first panel.

7. The watercraft of claim 2, wherein the second panel and the third panel have a wedge shape.

8. The watercraft of claim 2, wherein the hinge between the second panel and the third panel is a live hinge made of one of non-corrosive metal, fabric, and polymer.

9. The watercraft of claim 1, wherein the convertible seat assembly further comprises a third panel slidably connected to the second panel; and wherein in the second configuration the third panel rests at least partially on the reboarding platform.

10. The watercraft of claim 1, wherein the second panel has a handle.

11. The watercraft of claim 1, wherein in the first configuration, the first panel rests at least partially on the second panel, and the second panel prevents downward rotation of the first panel.

12. The watercraft of claim 1, wherein the second panel has two ends; and wherein in the second configuration, the end nearest to the wall is lower than the end furthest from the wall.

13. The watercraft of claim 1, wherein the first panel has two ends; and wherein in the first configuration the second panel is disposed between the two ends of the first panel.

14. The watercraft of claim 1, wherein the second panel is hingedly connected to at least one of the wall and the reboarding platform via a spring biasing the convertible seat assembly toward the first configuration.

15. The convertible seat assembly of claim 1, wherein at least one of the first panel and the second panel includes a cushion.

16. The watercraft of claim 1, wherein the watercraft comprises two convertible seat assemblies.

17. The watercraft of claim 1, further comprising a passenger area defined by the deck, the passenger area being separated at least partially from the reboarding platform by the wall; and wherein in the second configuration, the seat back faces away from the passenger area.

18. A convertible seat assembly for a reboarding platform of a watercraft, the convertible seat assembly comprising:

a first panel adapted to be pivotally connected to a wall of the watercraft; and a second panel adapted to be movably connected to at least one of the wall, the reboarding platform and the first panel, the convertible seat assembly having first and second configurations, in the first configuration the second panel supports at least partially the first panel generally horizontally above the second panel and the second panel is in a generally vertical position, and in the second configuration the first panel forms a generally vertical seat back and the second panel forms a generally horizontal seat bottom.

19. The convertible seat assembly of claim 18, further comprising a third panel hingedly connected to the second panel.

* * * * *